US010322059B2

(12) United States Patent
Tucker

(10) Patent No.: US 10,322,059 B2
(45) Date of Patent: Jun. 18, 2019

(54) MYOFASCIAL RELEASE TOOL

(71) Applicant: James William Tucker, Spokane Valley, WA (US)

(72) Inventor: James William Tucker, Spokane Valley, WA (US)

( * ) Notice: Subject to any disclaimer, the term of this patent is extended or adjusted under 35 U.S.C. 154(b) by 346 days.

(21) Appl. No.: 15/139,106

(22) Filed: Apr. 26, 2016

(65) Prior Publication Data

US 2017/0304144 A1 Oct. 26, 2017

(51) Int. Cl.
*A61H 23/00* (2006.01)
*A61H 7/00* (2006.01)

(52) U.S. Cl.
CPC ..... *A61H 23/00* (2013.01); *A61H 7/005* (2013.01); *A61H 2201/1664* (2013.01); *A61H 2201/1671* (2013.01); *A61H 2201/1685* (2013.01)

(58) Field of Classification Search
CPC ..... A61H 23/00; A61H 23/006; A61H 23/06; A61H 1/008; A61H 2023/002
See application file for complete search history.

(56) References Cited

U.S. PATENT DOCUMENTS 2,078,025 A * 4/1937 Samuels ..... A61H 23/0218 310/29
4,513,737 A * 4/1985 Mabuchi ..... A61H 23/0254 601/101
D695,413 S * 12/2013 Grust ..... D24/214
2003/0195443 A1* 10/2003 Miller ..... A61H 1/008 601/108
2006/0047315 A1* 3/2006 Colloca ..... A61H 1/008 606/239
2012/0271345 A1* 10/2012 Torres ..... A61H 7/001 606/204
2016/0008215 A1* 1/2016 Pfeiffer ..... A61H 23/02 600/38

* cited by examiner

*Primary Examiner* — Timothy A Stanis
(74) *Attorney, Agent, or Firm* — Lee & Hayes, P.C.

(57) ABSTRACT

Myofascial release tools may include a head covering and coupled to a post. The head may be constructed of at least partially of a polymeric material having a therapeutically effective durometer. The head may have a number of designs and configurations that may be used for treating different body parts and/or body tissues. An example head may have a partially concave portion that resembles an indent. Another example head may have an angled tip for more pointed therapy. Yet another example head may have a partially convex portion. These heads may be interchangeably and removably coupled to an oscillating device and used for myofascial release by a health care provider or patient.

16 Claims, 8 Drawing Sheets

MYOFASCIAL RELEASE TOOL

BACKGROUND

Myofascial release techniques find applicability in many fields, including massage therapy, physical therapy, and chiropractic care, for example to correct or improve the health of multiple body parts and tissues such as muscles and fascia. When muscles are sore or damaged, they may contract. Contracted muscles may lead to immobility and pain in the area of the contracted muscle. Fascia is a connective tissue that covers muscles. Fascia can become restrictive from, for example, overuse, trauma, and inflammation, which may lead to adhesion formation, further muscle spasm, and decreased blood flow to the corresponding muscle. Myofascial release techniques generally focus on relaxing contracted muscles and restricted fascia by stimulating proprioceptors and mechanoreceptors in the muscle of interest. Conventionally, myofascial release techniques include a therapist or chiropractor repeatedly pressing or "kneading" a muscle of interest until release is achieved. However, these techniques are laborious for the health care provider, often result in painful therapy for the patient, and allow the patient's reflexes to work against the health care provider, leading at times to less than favorable therapeutic results.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Overview

Figure 1:
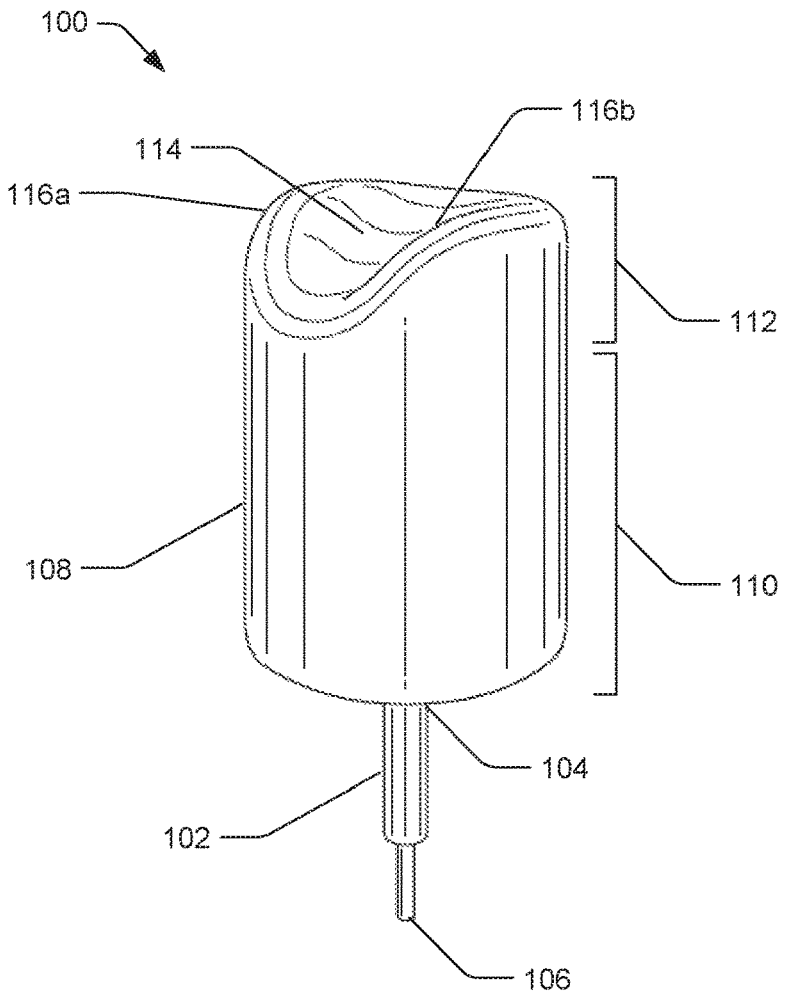
FIG. 1 illustrates a perspective view of an example myofascial release tool.

This overview, including section titles, is provided to introduce a selection of concepts in a simplified form that are further described below. The overview is provided for the reader's convenience and is not intended to limit the scope of the implementations or claims, nor the proceeding sections.

This disclosure describes myofascial release tools and methods of using the same.

As discussed above, myofascial release techniques are laborious for the treating health care provider, often result in painful therapy for the patient, and allow the patient's reflexes to work against the health care provider, leading to less than favorable therapeutic results. Example myofascial release tools and methods of using the same as described herein allow for myofascial release therapy and muscle tension reduction therapy that is easier and quicker to perform by a health care professional, results in decreased pain to the patient, and hinders the ability of the patient's reflexes to work against the health care provider. Additionally, the myofascial release tools and methods described herein provide treatment for a wider range of body tissues and parts than could be achieved through conventional myofascial release techniques, diversifying myofascial release applicability. The tools described herein alleviate the shortcomings of current myofascial release techniques by utilizing one or more tips that may be composed at least partially of thermoplastic elastomer with molecular bonding capabilities made from, at least in part, amorphous thermoplastic pellets designed as described below. Each of the one or more tips may be received in an oscillating device, such as a reciprocating saw, and the health care professional may engage the oscillating device to repeatedly contact a desired location of the patient's body. The design of the one or more tips accompanied by the repeated oscillation against the patient's body may provide effective myofascial release in a reduced amount of treatment time.

In an example, a myofascial release tool may comprise a post that may have a distal end and a proximal end. The proximal end may be sized to be received by an oscillating device. The myofascial release tool may also comprise a head, which may be constructed at least partially of a polymeric material. The polymeric material may cover at least a portion of the distal end of the post and may be coupled to the post. The head may have a durometer sufficient to provide a therapeutic effect to a desired location of the patient's body. The durometer may vary depending on the location of treatment, therapeutic effect, or clinical application desired by the health care provider.

In an example, a myofascial release tool may comprise a tip that may include a post and a head coupled to a first end of the post. The head may be constructed at least partially of a polymeric material having a durometer sufficient to provide a therapeutic effect to a desired location of the patient's body. The myofascial release tool may also comprise an oscillating device configured to receive a second end of the post.

In an example, a myofascial release apparatus may comprise a plurality of tips. Each tip of the plurality of tips may have a proximal end sized to be received at least partially in an oscillating device. The plurality of tips may also be interchangeable and may be constructed at least partially of a polymeric material. The plurality of tips may be designed to have differing structures and/or designs to provide varying therapeutic effects to varying areas of the patient's body.

In an example, a method of using myofascial release tools may comprise oscillating at least one of the plurality of tips on a desired portion of the patient's body. The oscillating may be accomplished by operation of an oscillating device with a tip received by the oscillating device. A health care provider may choose a tip from the plurality of tips that is designed for use on a specific portion of the patient's body and/or for treatment of specific tissue (e.g., muscle, tendon, ligament, bone, fascia, etc.). The health care provider may connect the chosen tip to the oscillating device. The health care provider may contact the tip with the body of the patient and enable the oscillating device to begin oscillation. The health care provider may exert a certain amount of force during oscillation depending on the chosen tip and desired therapeutic effect. The health care provider may change tips during a treatment session to treat additional areas of the body and/or additional tissues. The tips may comprise varying durometers and designs and be interchangeable without substantial effort or time.

Myofascial release tools according to this disclosure may be designed for a variety of applications, such as, for example, physical therapy, massage therapy, chiropractic care, or for use by a patient without aid from a health care provider. The myofascial release tools according to this disclosure may be used on various parts of the body, including, for example, skeletal muscles, fascia, tendons, ligaments, and the connections between bone and any other connective tissue.

One or more examples of the present disclosure are illustrated in the accompanying drawings. Those of ordinary skill in the art will understand that the tools and methods specifically described herein and illustrated in the accompanying drawings are non-limiting examples and that the scope of these examples is defined solely by the claims. The features illustrated or described in connection with one example may be combined with the features of other examples. For example, design elements described with respect to one example may be incorporated, in whole or in part, into the design elements of another example. Such modifications and variations are intended to be included within the scope of the appended claims.

Additional details are described below with reference to several examples.

Example Devices

FIGS. 1-7 illustrate various examples of myofascial release tools. Unless otherwise expressly stated, the sizes, shapes, and symbols used to describe the various components of the tools are used for illustration only and should not be used as limitations of the tools as described herein.

FIG. 1 is a perspective view of an example of a myofascial release tool 100. The tool 100 may include a post 102. The post 102 may have a distal end 104 and a proximal end 106. The proximal end 106 may be sized to be received by an oscillating device. In an example, the oscillating device may be any device that provides oscillating motion, such as, for example, a reciprocating saw, an oscillating saw, or sabre saw. The oscillating device may enable oscillation of a tip in a substantially linear motion from, for example, approximately 1 revolution per minute (RPM) to approximately 3,000 RPM. In other examples, the oscillation of the tip may be in a circular motion or a random motion. In still other examples, the oscillation of the tip may be in a sweeping motion, such that the oscillation causes the tip to move back and forth in a direction tangential to the oscillating device. In other examples, as used herein, RPM may be alternatively defined as strokes per minute. In an example, the oscillating device may oscillate at more than 3,000 RPM. For example, the oscillating device may oscillate at at least 3,000 RPM, at least 3,500 RPM, at least 4,000 RPM, at least 4,500 RPM, at least 5,000 RPM, or more. The post 102 may be tooled to include grooves, indents, and other configurations to allow the proximal end 106 to be received within a particular oscillating device. The post 102 may be tooled such that, when received by the oscillating device, the post 102 lockedly couples with the oscillating device. Coupling of the post 102 to the oscillating device may be desired during use of tool 100 as described more fully herein. The post 102 may be uncoupled from the oscillating device to allow for storage or for additional tools 100 to be used. In an example, the oscillating tool may be a tool sold in home improvement stores, without modification. In an example, the oscillating tool may be modified to provide, for example, a reconfigured connection mechanism to receive the post 102, increased control over RPMs, a reconfigured handle, or other components that allow for easier treatment of a patient.

The tool 100 may also comprise a head 108. The head 108 may be constructed at least partially of a polymeric material. The head 108 may cover at least a portion of the distal end 104 of the post 102. The head 108 may also be coupled to the post 102. In an example, the head 108 may be releasably coupled to the post 102, which may allow a user to remove the head 108 from the post 102. In an example, the polymeric material may include, but is not limited to, amorphous thermoplastic pellets and/or thermoplastic elastomers. The head 108 and post 102 may be two separate components that are coupled together, or the head 108 and the post 102 may comprise a single component. The head 108 and post 102, whether constructed as separate components or a single component, may otherwise be described as a tip.

The head 108 may have a durometer sufficient to provide therapeutic treatment to a patient. The specific durometer of head 108 may vary depending on the desired bodily area of treatment, the desired tissue to be treated, and a host of other factors including but not limited to the physical condition of the patient, patient age, patent pain tolerance, past medical history of the patient, and previous efficacy of myofascial release treatments. In an example, the durometer may be between approximately 10 A and approximately 50 A. As used herein, durometer is measured based on the Shore Hardness Scale. For example, the Shore A scale is used to define the durometer in this disclosure. However, it should be understood that other units of measuring hardness are not excluded from this disclosure. For example, a Shore A durometer of 10 A may equate to a roughly 55 durometer on the Shore 00 scale. Likewise, a Shore A durometer of 70 A may equate to a roughly 14D durometer on the Shore D scale. Other units of hardness may also be used.

In an example, the durometer of the head 108 may be at least 5 A, at least 10 A, at least 20 A, at least 30 A, at least 40 A, at least 50 A, at least 60 A, or at least 70 A. In an example, the durometer of the head 108 may be less than 70 A, less than 60 A, less than 50 A, less than 40 A, less than 30 A, less than 20 A, less than 10 A, or less than 5 A. In an example, the durometer of the head 108 may be between approximately 10 A and approximately 50 A, or between approximately 15 A and approximately 40 A, or between approximately 10 A and approximately 20 A, or between approximately 20 A and approximately 30 A, or between approximately 30 A and approximately 40 A, or between approximately 40 A and approximately 50 A, or between approximately 50 A and approximately 60 A, or between approximately 60 A and approximately 70 A.

Treatment of a certain body part, a certain tissue type, or a certain patient may influence the durometer. By way of example, during treatment of a large muscle, such as a pectoral muscle, quadriceps, or hamstrings, or during treatment of a patient with a more athletic build, a higher durometer may be optimal to provide increased impact to the muscle during treatment. In this example, the durometer of the head 108 may be, for example, approximately 40 A or greater. In other examples, such as during treatment of smaller muscle groups, or for use on soft tissue, or for use on a patient with average muscle tone and having average health, the head 108 may have a durometer of, for example, approximately 30 A. In still other examples, such as during treatment of skeletal tissues, or certain tendons or ligaments, or for use on a fragile patient, the head 108 may have a durometer of, for example approximately 20 A or less.

The head 108 may also comprise a variety of designs or configurations. For example, the head 108 may include a first portion 110 that may be substantially cylindrical in shape. The length and diameter of the first portion 110 may vary given a desired treatment application of the head 108. In an example, the first portion 110 may be approximately two inches in length and approximately an inch and a half in diameter. In further examples, the first portion 110 may be between 0.1 inches and 0.5 inches in length, between 0.5 inches and 1.0 inches in length, between 1.0 inches and 1.5 inches in length, between 1.5 inches and 2.0 inches in length, between 2.0 inches and 3.0 inches in length, or more than 3.0 inches in length. In further examples, the first portion 110 may be between 0.1 inches and 0.5 inches in diameter, between 0.5 inches and 1.0 inches in diameter, between 1.0 inches and 1.5 inches in diameter, between 1.5 inches and 2.0 inches in diameter, between 2.0 inches and 3.0 inches in diameter, or more than 3.0 inches in diameter. In should be noted that the dimensions of the first portion 110 may be measured in terms of radius instead of or in addition to diameter. Additionally, while the units of measurement used herein include inches, those units of measurement are not exclusive. To the contrary, the metric equivalent of these measures is also included. Specifically, the first portion 110 may be measured in terms of centimeters, is some examples. The head 108 may also comprise a second portion 112 that may be at least partially concave such that an indent 114 may be defined on the second portion 112 of the head 108. In an example, the indent 114 may have a depth gradient such that the indent 114 may be more pronounced on one side of the second portion 112 and less pronounced on another side of the second portion 112. In an example, the indent 114 may be substantially uniform in depth across the second portion 112 of the head 108.

The configuration of the second portion 112 may resemble a groove with side walls (labeled as 116*a* and 116*b*). The side walls of the second portion 112 may surround the entire indent 114, or the side walls may surround only a portion of the indent 114 such that the indent 114 resembles a channel. By way of example, the configuration of the head 108 as shown in FIG. 1 may be used on narrow or small portions of the patient's body, such as the iliotibial band, forearm muscles, calf muscles, trapezius, triceps, and biceps, for example. In use, the oscillated device may receive the tool 100 and the health care provider may enable the oscillating device such that the tool 100 oscillates. The health care provider may place the tool 100 over the desired portion of the patient's body such that all or a portion of the desired portion rests in the indent 114 and is straddled by the side walls of the second portion 112. This configuration of the tool 100 may allow the health care provider to move the tool 100 up and down a muscle while keeping the tool 100 from vibrating off of the body part of interest.

The configuration of the second portion 112 may also resemble a double groove. In examples, one groove of the double groove may be situated toward the center of the second portion 112 and be narrower than a second groove. In these examples, the one groove may appear to be a groove within the second groove. When in use, the one groove may be used on narrow or small portions of the patient's body, while the second, wider groove may be used on wider portions of the patient's body.

Figure 2:
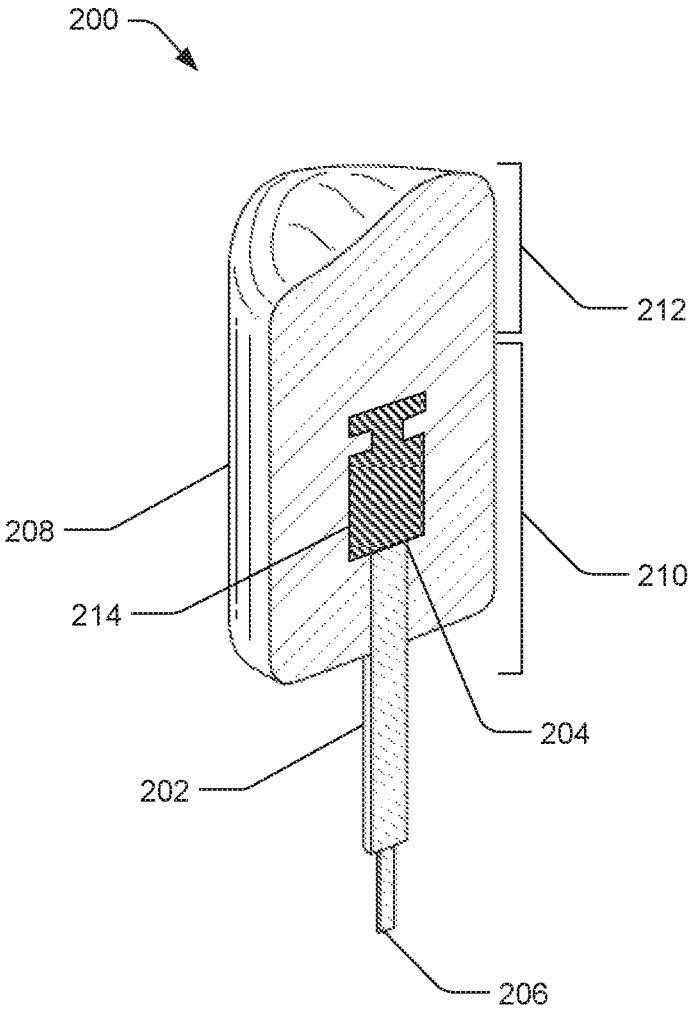
FIG. 2 illustrates a cross-sectional view along the center of an example myofascial release tool.

FIG. 2 illustrates a cross-sectional side view of an example myofascial release tool 200. The cross-section shown in FIG. 2 is made at or near the center of tool 200 such that the head and post are essentially split in half. Tool 200 may comprise the same or similar components as tool 100. For example, tool 200 may include a post 202 having a distal end 204 and a proximal end 206, and a head 208 having a first portion 210 and a second portion 212. Tool 200 may also include a core 214. Core 214 may comprise a component separate from the post 202, or the core 214 may comprise a portion of the post 202 that is coupled to the head 208. The core 214 may be shaped to secure the head 208 to the core 214, such as, for example, by one or more grooves that prohibit or hinder separation of the core 214 from the head 208. In an example, the core 214 may have locking and unlocking capabilities such that, when locked, the core 214 is prohibited or hindered from disengaging from the head 208, and when unlocked, a user may disengage the core 214 from the head 208.

When the core 214 is a separate component from the post 202, the core 214 may be secured to the post 202 through multiple attachment means, such as for example, tongue-in-groove designs, rivets, adhesive, threads, screws, and/or by a ball bearing system. In an example, using threaded attachment means, the core 214 may be screwed on and off the post 202. In another example, using a ball bearing attachment means, the core 214 may lockedly engage the post 202 when the ball bearings are engaged. An operator may exert opposing forces on the ball bearing system to disengage the ball bearings and allow the core 214 to be removed from the post 202. The shape of the core 214 may vary with, for example, the shape and design of the head 208. As described above with respect to FIG. 1, the head 208 may have a variety of designs and shapes. The core 214 may have a substantially similar design and/or shape to a given head 208, or the shape of the core 214 may be independent of the shape of a given head 208. In examples where the post 202 and the head 208 are a single component, the core 214 may be absent or may define a portion of the head 208.

In examples, the head 208 may be configured as a cover that engages with the core 214. The head 208 may slip on to, or otherwise be sized to fit snugly on the core 214. In examples, the core 214 may be made of at least a partially polymeric material with a durometer that is similar to that of the head 208. In an example, the core 214 may have a durometer that is greater than that of the head 208. The core 214 may also be constructed at least partially of a sponge material, metal, and/or stone.

Figure 3:
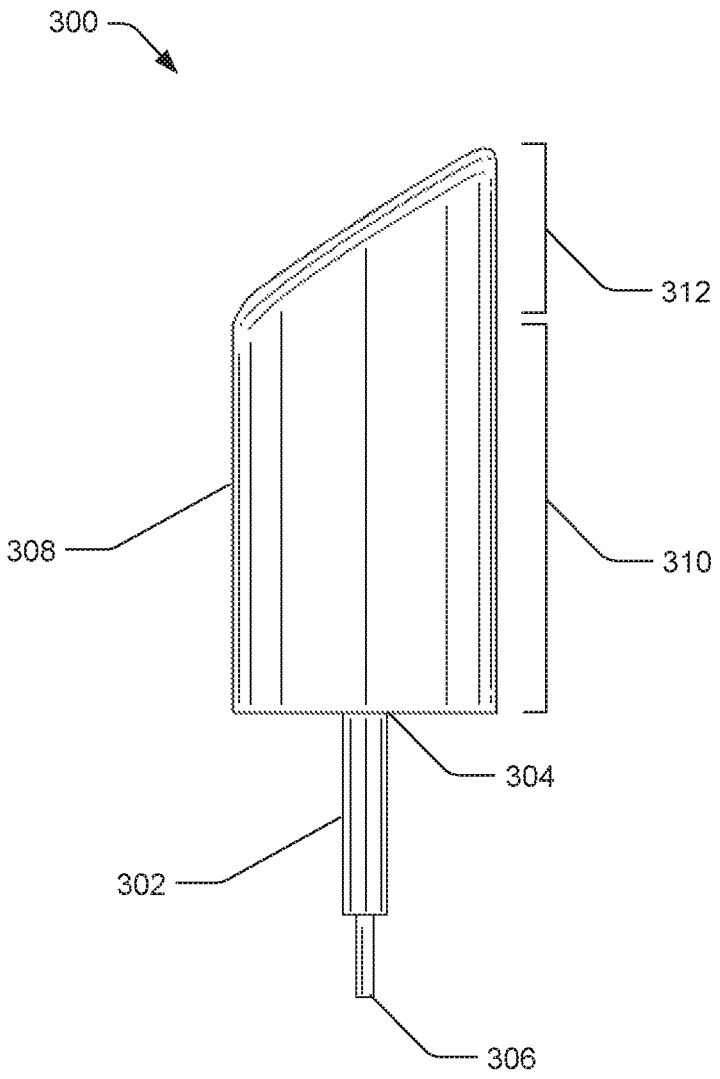
FIG. 3 illustrates a side view of another example myofascial release tool.

FIG. 3 illustrates a side view of an example myofascial release tool 300. Tool 300 may comprise the same or similar components as tool 100. For example, tool 300 may comprise a post 302 having a distal end 304 and a proximal end 306, and a head 308 having a first portion 310 and a second portion 312. Tool 300 may also comprise a design that differs from tool 100. For example, the first portion 310 of head 308 may be substantially cylindrical, while the second portion 312 of head 308 may be angled such that one side of the second portion 312 is higher than another side of the second portion 312. The length and diameter of the first portion 310 may vary given a desired treatment application of the head 308. In an example, the first portion 310 may be approximately two inches in length and approximately an inch and a half in diameter. In further examples, the first portion 310 may be between 0.1 inches and 0.5 inches in length, between 0.5 inches and 1.0 inches in length, between 1.0 inches and 1.5 inches in length, between 1.5 inches and 2.0 inches in length, between 2.0 inches and 3.0 inches in length, or more than 3.0 inches in length. In further examples, the first portion 310 may be between 0.1 inches and 0.5 inches in diameter, between 0.5 inches and 1.0 inches in diameter, between 1.0 inches and 1.5 inches in diameter, between 1.5 inches and 2.0 inches in diameter, between 2.0 inches and 3.0 inches in diameter, or more than 3.0 inches in diameter. In should be noted that the dimensions of the first portion 310 may be measured in terms of radius instead of or in addition to diameter. Additionally, while the units of measurement used herein include inches, those units of measurement are not exclusive. To the contrary, the metric equivalent of these measures is also included. Specifically, the first portion 310 may be measured in terms of centimeters, is some examples.

In an example, the second portion 312 may resemble a pointed or substantially pointed end. Tool 300 may be used, for example, for myofascial release on an area of the body that requires more focused pressure than tool 100, wherein the substantially pointed end of the second portion 312 contacts the patient. Tool 300 may be used, for example, on portions of a patient's neck, on or around a patient's clavicle, and on areas where muscle connects to bone. The diameter of tool 300 may be the same as the diameter of tool 100, or tool 300 may have a different diameter. In an example, tool 300 has a smaller diameter to allow for further pinpointed pressure to be applied to the patient. In an example, the design of the second portion 312 creates a sloped end of the head 308.

A health care provider may use tool 300 by contacting the patient with the sloped portion of the head 308 instead of, or in addition to, the substantially pointed portion. By treating a patient with the sloped portion of the head 308, pressure created during treatment may be partially deflected away from the area of treatment. The health care provider may adjust the angle at which the head 308 contacts the patient to increase or decrease contact with the sloped portion of the head 308. This design may allow for in-treatment control and adjustment of myofascial release pressure in response to patient feedback and reaction.

The angle of the second portion 312 of the head 308 may vary. In an example, the angle may be only slightly greater than 0° to allow for a flatter surface to apply to a patient. In other examples, the angle may be any angle between approximately 0° and approximately 90°, such as, for example, between 0° and 15°, between 15° and 30°, between 30° and 45°, between 45° and 60°, between 60° and 75°, or between 75° and 90°, which may allow for a more pointed surface to apply to a patient. In an example, the angle of the second portion 312 may be approximately 45°. In this example, the substantially pointed portion created by the angled design may be used to contact the patient, and/or the sloped portion may be used during the same treatment session, for example. The substantially pointed portion may have a substantially straight edge or may be slightly rounded.

Figure 4:
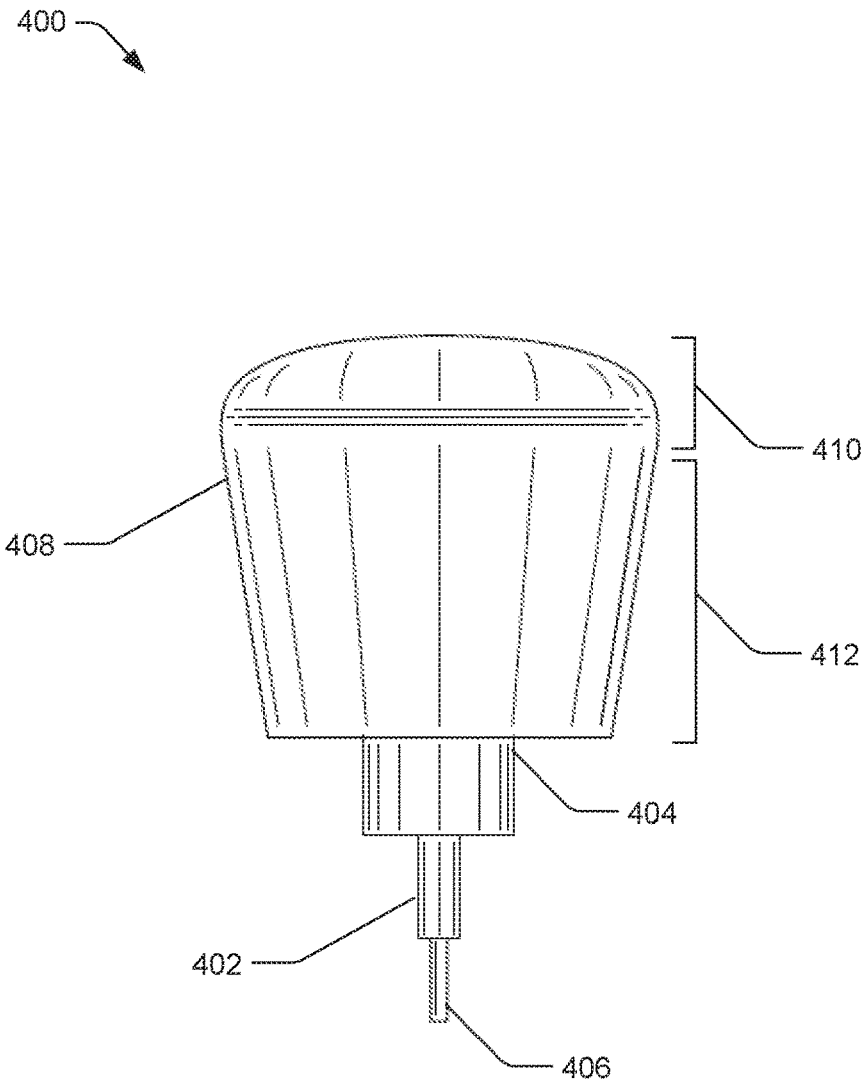
FIG. 4 illustrates a side view of a further example myofascial release tool.

FIG. 4 illustrates a side view of an example myofascial release tool 400. Tool 400 may include the same or similar components as tool 100. For example, tool 400 may comprise a post 402 having a distal end 404 and a proximal end 406, and a head 408. Tool 400 may comprise a design that differs in some respects from the design of tool 100 and/or tool 300. For example, the head 408 of tool 400 may comprise a first end 410 that is at least partially convex. In an example, the second end 412 may be substantially cylindrical. The length and diameter of the second end 412 may vary given a desired treatment application of the head 408. In an example, the second end 412 may be approximately two inches in length and approximately an inch and a half in diameter. In further examples, the second end 412 may be between 0.1 inches and 0.5 inches in length, between 0.5 inches and 1.0 inches in length, between 1.0 inches and 1.5 inches in length, between 1.5 inches and 2.0 inches in length, between 2.0 inches and 3.0 inches in length, or more than 3.0 inches in length. In further examples, the second end 412 may be between 0.1 inches and 0.5 inches in diameter, between 0.5 inches and 1.0 inches in diameter, between 1.0 inches and 1.5 inches in diameter, between 1.5 inches and 2.0 inches in diameter, between 2.0 inches and 3.0 inches in diameter, or more than 3.0 inches in diameter. In an example, the second end 412 may have a partially conical shape such that the end of the head 408 nearest the post 402 has a smaller diameter than the end of the head opposing the post 402. The difference between the diameters on either end of the head 408 may vary given a desired application of the head 408. In should be noted that the dimensions of the second end 412 may be measured in terms of radius instead of or in addition to diameter. Additionally, while the units of measurement used herein include inches, those units of measurement are not exclusive. To the contrary, the metric equivalent of these measures is also included. Specifically, the second end 412 may be measured in terms of centimeters, is some examples.

For example, when treatment of a thicker muscle group or an athletically-built patient is desired, the difference between the diameters may be negligible or slight. This may provide a head 408 with additional weight and durability, which in turn may provide the health care provider with the ability to increase pressure of tool 400 during treatment. In an example, such as when treating thinner muscle groups, the diameter of the head 408 nearest the post 402 may be, sometimes substantially, smaller than the diameter of the head 408 on the end opposing the post 402. This may provide a head 408 with less weight, which may be desired when the surface area of treatment is comparatively large but increased pressure is not desired, such as when treating a less athletically-built patient.

The degree of protuberance of the convex-shaped first end 410 may also vary. In an example, the degree of protuberance may be slight, such that the surface of the head 408 that contacts the patient is only slightly convex. In other examples, the degree of protuberance may more pronounced, such that the surface of the head 408 that contacts the patient is appreciably convex, which may resemble a more rounded surface.

The overall size of the head 408 may be similar to the head sizes of tool 100 and/or tool 300, or the size of the head 408 may vary from tool 100 and/or tool 300. For example, the head 408 may be larger than head 108 or head 308 in one or more respects. The head 408 may have an overall diameter of more than 1 inch, more than 1.5 inches, more than 2 inches, more than 2.5 inches, more than 3 inches, more than 3.5 inches, more than 4 inches, more than 4.5 inches, or more than 5 inches. Additionally, the length of the head 408 may be more than 1 inch, more than 1.5 inches, more than 2 inches, more than 2.5 inches, more than 3 inches, more than 3.5 inches, or more than 4 inches. Furthermore, the curvature of the convex first end 410 may vary by the inverse length of the radius of the first end 410. In should be noted that the dimensions of the head 408 may be measured in terms of radius instead of or in addition to diameter. Additionally, while the units of measurement used herein include inches, those units of measurement are not exclusive. To the contrary, the metric equivalent of these measures is also included. Specifically, the head 408 may be measured in terms of centimeters, is some examples.

Figure 5:
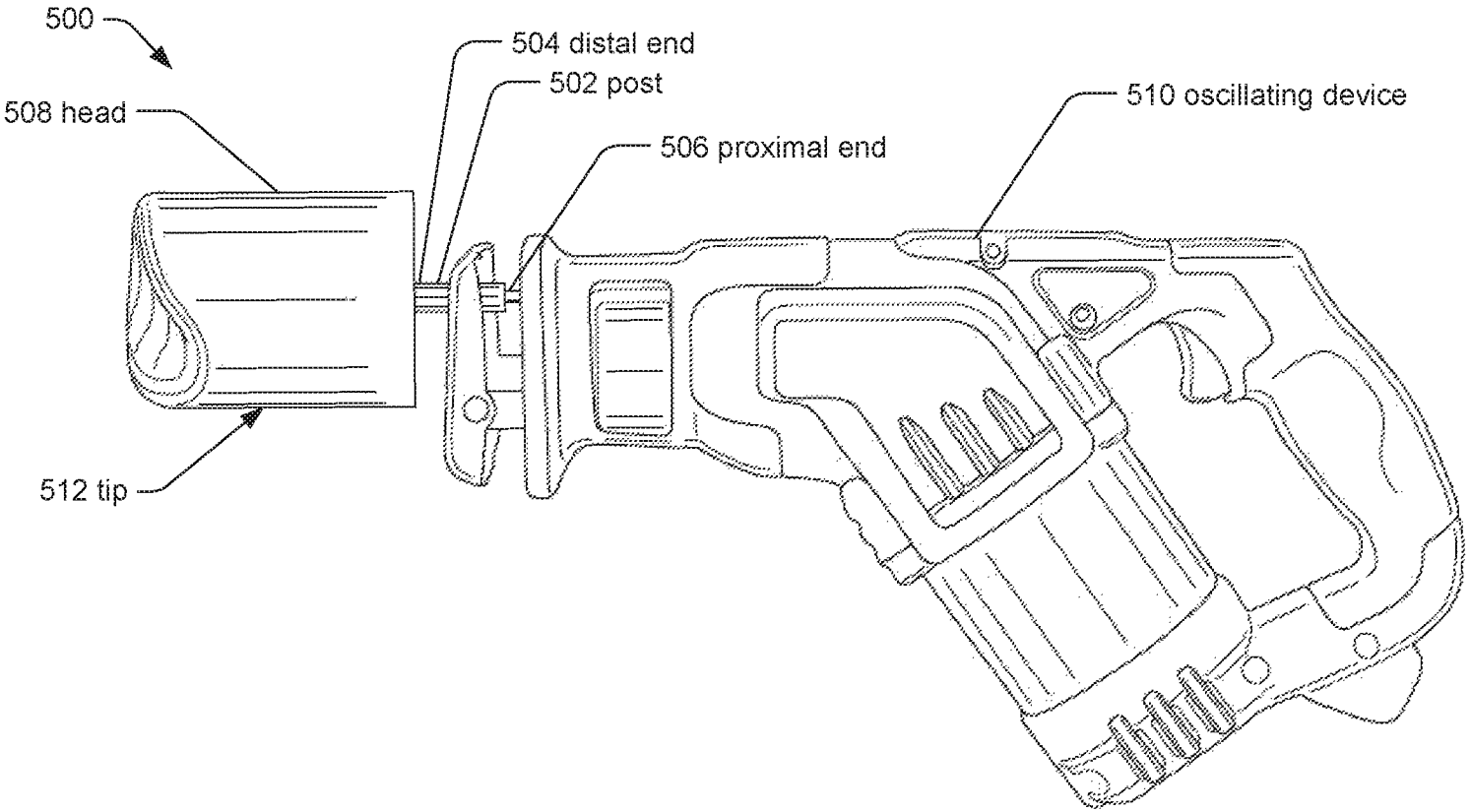
FIG. 5 illustrates a side view of a myofascial release tool and an oscillating device.

FIG. 5 illustrates a side view of an example myofascial release apparatus 500. Apparatus 500 may comprise the same or similar components as tool 100. For example, apparatus 500 may comprise a post 502 having a distal end

504 and a proximal end 506, and a head 508. Apparatus 500 may also comprise an oscillating device 510, and the post 502 and head 508 may collectively represent a tip 512. As shown in FIG. 5, the proximal end 506 of the post 502 may be sized to be received by the oscillating device 510. The proximal end 506 of the post 502 may contain grooves and/or slots configured to allow the post 502 to fit into a common oscillating device such as, for example, a reciprocating device. In other examples, the receptacle portion of the oscillating device 510 may be configured to specifically receive post 502 as described herein.

In an example, the oscillating device 510 may oscillate the post 502 in a substantially linear motion from, for example, approximately 1 RPM to approximately 3,000 RPM. In other examples, the RPM may be alternatively defined as strokes per minute. In an example, the oscillating device 510 may oscillate at more than 3,000 RPM. For example, the oscillating device may oscillate at at least 3,000 RPM, at least 3,500 RPM, at least 4,000 RPM, at least 4,500 RPM, at least 5,000 RPM, or more. The post 502 may be tooled to include grooves, indents, and other configurations to allow the proximal end 506 to be received within the oscillating device 510. The post 502 may be tooled such that, when received by the oscillating device 510, the post 502 lockedly couples with the oscillating device 510. Coupling of the post 502 to the oscillating device 510 may be desired during use of apparatus 500 as described more fully herein. The post 502 may be uncoupled from the oscillating device 510 to allow for storage or for additional tips 512 to be used. In an example, the oscillating tool 510 may be a tool sold in home improvement stores, without modification. In other examples, the oscillating tool 510 may be modified to provide, for example, a reconfigured connection mechanism to receive the post 502, increased control over RPMs, a reconfigured handle, or other components that allow for easier treatment of a patient.

Apparatus 500 may be used in connection with a variety of tips 512, such as, for example, tool 100, tool 200, tool 300, and/or tool 400. The tips 512 may be interchangeable, such that, for example, tool 100 can be initially received in the oscillating device 510 and can be removed and replaced with, for example, tool 200, which could be removed and replaced with, for example, tool 300, which could be removed and replaced with, for example, tool 400.

The tips 512 may also be rotatable about the post 502, such that the tip 512 and/or the post 502 and/or the head 508 may rotate. In an example, the tips 512 may be freely rotatable by providing a turning force in the desired direction of rotation. A certain threshold of force may be required to rotate the tips 512. In an example, the tips 512 may include one or more notches that may allow the tips 512 to snap into differing rotatable positions when received by the oscillating device 510. In an example, the tips 512 may include one or more ball bearing assemblies that may allow the tips 512 to rotate when the ball bearings are disengaged, but may not allow the tips 512 to rotate when the ball bearings are engaged. During a treatment session, the health care provider may rotate the tip 512 received by the oscillating device 510 to promote treatment of a given area of the body.

For example, using tool 300, which includes an angled head design, the health care provider may adjust the tip 512 such that the substantially pointed end is on the left side of the tip 512 when viewed from behind the oscillating device 510 from the perspective of the health care provider. The health care provider may start treatment on a given area on the left side of the patient's body, such as, for example, the left side of the patient's neck. The health care provider may then desire to treatment the right side of the patient's neck and may rotate the tip 512 such that the substantially pointed end is on the right side of the tip when viewed from behind the oscillating device 510 from the perspective of the health care provider. This may allow the health care provider to treat the right side of the patient's neck in the same manner as treatment on the left side of the neck. Treatment of other areas of the body not provided by way of example may also benefit from the rotatably of the tips 512.

In an example, the tips 512 may have a portion with a first durometer and another portion with a second durometer. For example, the portion of the tip 512 that is nearest the oscillating device 510, when received therein, may have a greater durometer than a portion of the tip that is opposing the oscillating device 510. For example, with reference to tool 100, the first portion 110 of the head 108 may have a first durometer such as, for example, of 50 A. The second portion 112 of the head 108 may have a second durometer such as, for example, of 30 A. The head 108 in these examples have provide a more durable base for the head 108 and allow the head 108 to more securely couple to the post 102 while also providing a softer portion that contacts the patient. The differences in durometer may be present as between different sections of the tip 512, or tip 512 may have a gradient of differing durometers.

Figure 6:
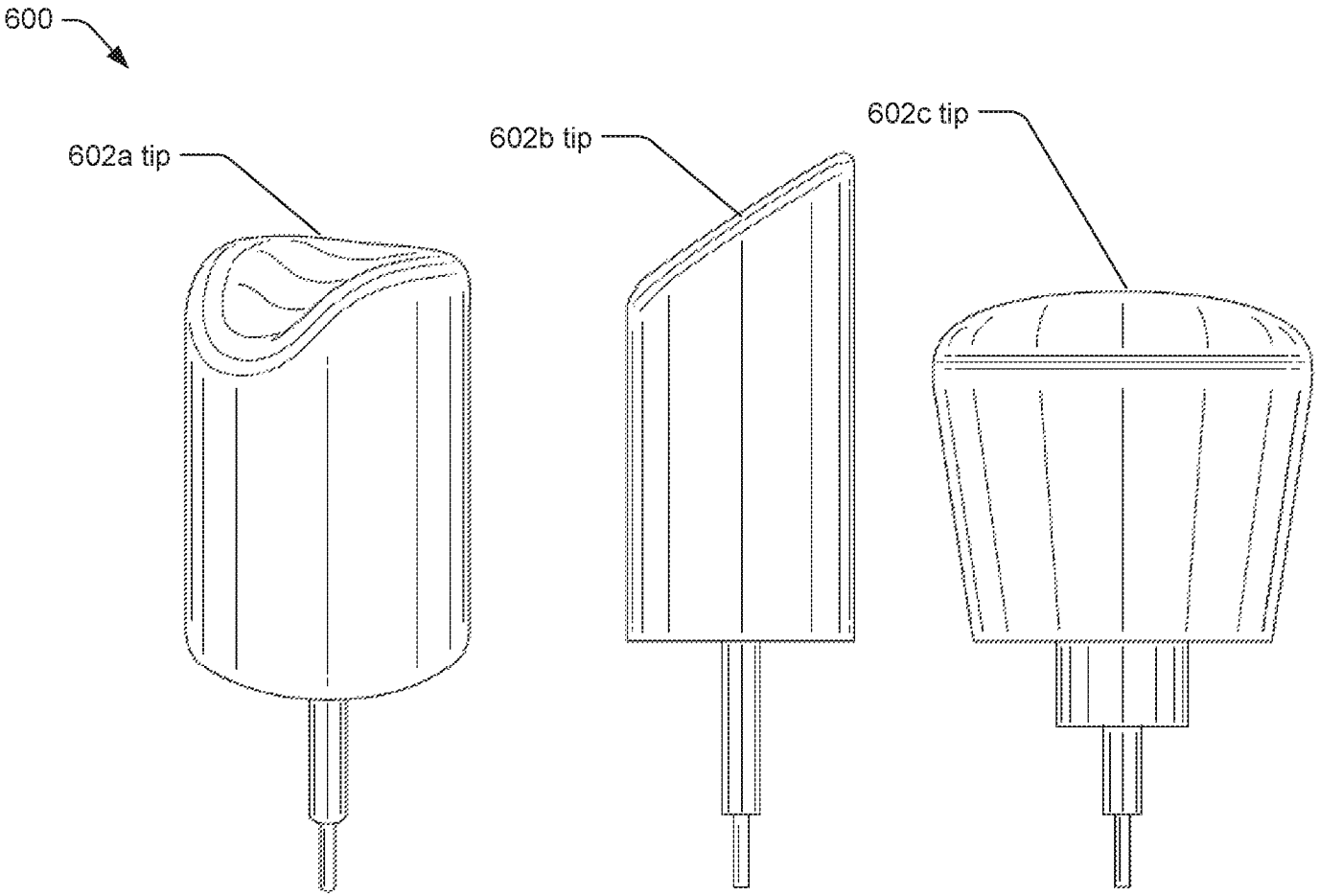
FIG. 6 illustrates a plurality of tips of an example myofascial release apparatus.

FIG. 6 illustrates a plurality of tips of an example myofascial release apparatus 600. Apparatus 600 may comprise a plurality of tips 602 (labeled 602*a*, 602*b*, and 602*c*). The plurality of tips may include 2 tips, 3 tips, or more tips. Each tip of the plurality of tips may be uniform in size, shape, or design, or a tip of the plurality of tips may differ in size, shape, or design from any or all of the other tips of the plurality of tips. In an example, the plurality of tips may comprise the designs of tool 100, tool 200, tool 300, and/or tool 400. In an embodiment, the plurality of tips 602 may comprise the same or similar features, and be constructed of similar materials as tool 100, tool 200, tool 300, and/or tool 400. The plurality of tips 602 may be interchangeable, as described above, and the plurality of tips 602 may be rotatable, also as described above. For example, tool 500 may comprise a post 502 having a distal end 504 and a proximal end 506, and a head 508. Tool 500 may also be constructed of the same or similar materials as tool 100, tool 200, tool 300, and/or tool 400.

Figure 7:
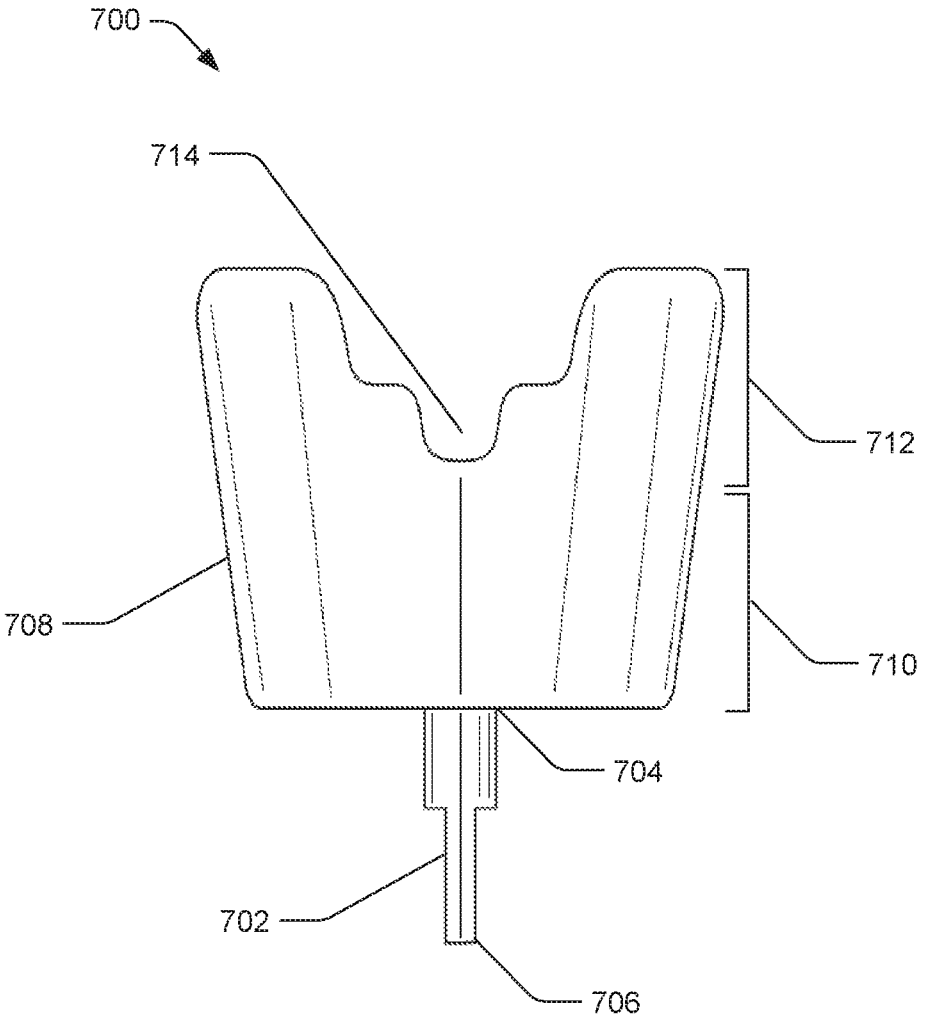
FIG. 7 illustrates a side view of another example myofascial release tool.

FIG. 7 illustrates a side view of an example myofascial release tool 700. Tool 700 may comprise the same or similar components as tool 100. For example, tool 700 may comprise a post 702 having a distal end 704 and a proximal end 706, and a head 708 having a first portion 710 and a second portion 712. Tool 700 may also comprise a design that differs from tool 100. For example, the first portion 410 may have a partially conical shape such that the end of the head 708 nearest the post 702 has a smaller diameter than the end of the head 708 opposing the post 702. The difference between the diameters on either end of the head 708 may vary given a desired application of the head 708. In should be noted that the dimensions of the first portion 410 may be measured in terms of radius instead of or in addition to diameter.

The second portion 712 of the head 708 may have various indents 714. In examples, the design of tool 700 may have a double indent 714, wherein the indent 714 has a portion that is wider than another portion, as shown in FIG. 7. Tool 700 may allow a practitioner to situate a portion of a patient's body in the indent and provide myofascial release as described herein. Certain portions of the patient's body may be larger, and as such, may fit at least partially within the wider portion of the indent 714. Certain other portions of the patient's body may be smaller or thinner, and as such, may fit at least partially within the narrower portion of the indent 714. This double indent design may allow a practitioner to provide myofascial release to various parts of a patient's body without interrupting treatment to change tips.

As described in FIGS. 1-7, various components of tools 100-400 and 700, and apparatuses 500-600, have been described as components of certain examples of the myofascial release tools and apparatuses described herein. However, it should be understood that in some examples each component described herein may be included in any or all of tools 100-400 and 700, and apparatuses 500-600, and the inclusion of a component in one example does not exclude its potential inclusion in other examples. Additionally, multiples of the components of tools 100-400 and 700, and apparatuses 500-600, may also be included.

The tools and apparatuses described in FIGS. 1-7 may alleviate some or all of the shortcomings of current myofascial release techniques by decreasing physical effort required by a health care professional, decreasing pain to the patient, and hindering the ability of the patient's reflexes to work against the health care provider. Additionally, the myofascial release tools and methods described herein provide treatment for a wider range of body tissues and parts than could be achieved through conventional myofascial release techniques, diversifying myofascial release applicability.

Example Methods

Figure 8:
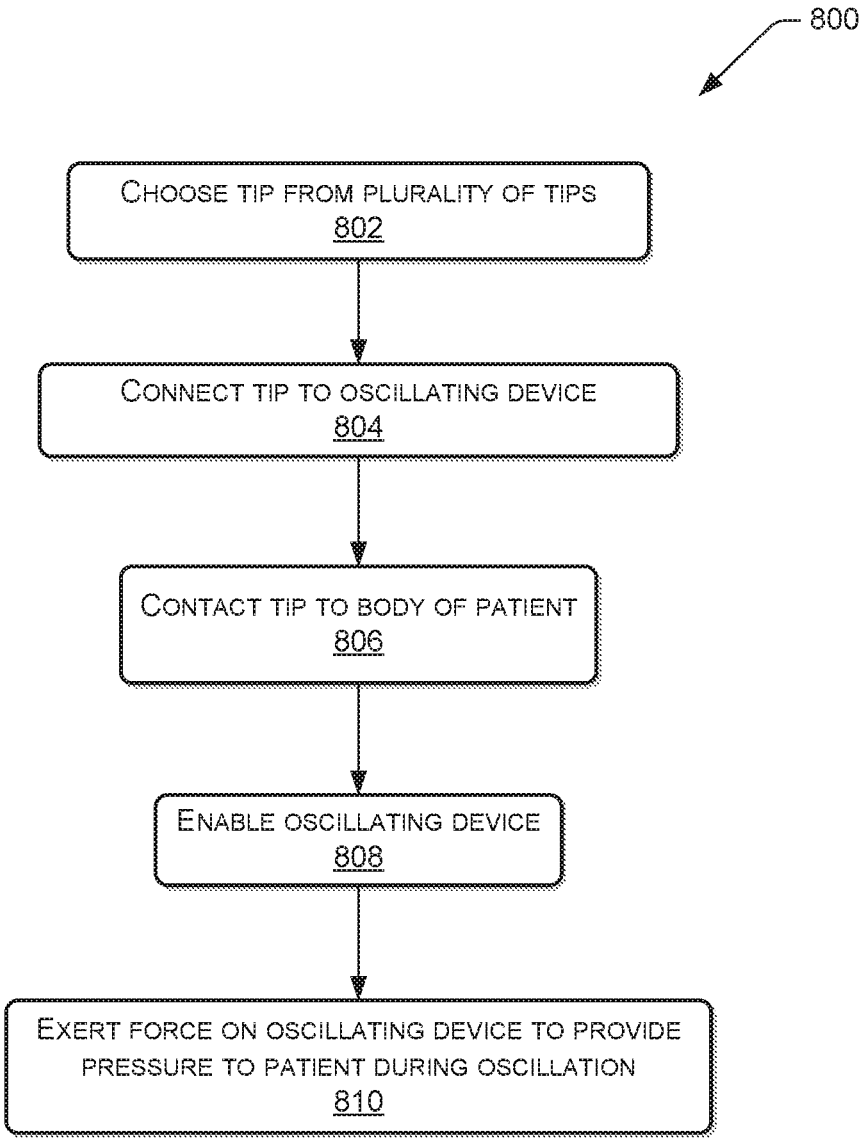
FIG. 8 is a flowchart illustrating an example method by which a myofascial release device may be operated.

Also disclosed herein are methods of using a myofascial release tool, such as those described herein. FIG. 8 illustrates an example method of operating a myofascial release tool, such as described herein. Method 800 is illustrated as a logical flow graph. The order in which the operations or steps are described is not intended to be construed as a limitation, and any number of the described operations can be omitted, modified, or combined in any order and/or in parallel to implement method 800.

In an example, a method of using myofascial release tools may include oscillating at least one of a plurality of potential tips on a desired portion of a patient's body. The oscillating may be accomplished by operation of an oscillating device with a tip received by the oscillating device.

At block 802, method 800 may include choosing a tip from the plurality of tips that is designed for or otherwise could be used on a specific portion of the patient's body and/or for treatment of specific tissue (e.g., muscle, tendon, ligament, etc.).

At block 804, method 800 may include connecting the chosen tip to the oscillating device. The tips chosen by the health care provider may comprise a variety of designs and configurations. For example, the tip may comprise a first portion that may be substantially cylindrical in shape and a second portion that may be at least partially concave such that an indent may be defined on the second portion of the tip. In an example, the indent may have a depth gradient such that the indent may be more pronounced on one side of the second portion and less pronounced on another side of the second portion. In other examples, the indent may be substantially uniform in depth across the second portion of the tip. This tip may be used on narrow or small portions of the patient's body, such as the iliotibial band, forearm muscles, calf muscles, trapezius, triceps, and biceps, for example.

The design of the tip may also, or alternatively, comprise a first portion that may be substantially cylindrical, while a second portion may be angled such that one side of the second portion is higher than another side of the second portion. The tip described in this example may be used, for example, for myofascial release on an area of the body that requires more focused pressure than other tips, wherein the substantially pointed end of the second portion contacts the patient. This tip may be used, for example, on portions of a patient's neck, on or around a patient's clavicle, and on areas where muscle connects to bone. This design may allow for in-treatment control and adjustment of myofascial release pressure in response to patient feedback and reaction.

The design of the tip may also, or alternatively, comprise a first end that is at least partially convex. In an example, the second end may be substantially cylindrical. The second end may have a partially conical shape such that the end of the tip nearest the oscillating device has a smaller diameter than the end of the tip opposing the oscillating device. The difference between the diameters on either end of the tip may vary given a desired application. For example, when treatment of a thicker muscle group or an athletically-built patient is desired, the difference between the diameters may be negligible or slight. This may provide a tip with additional weight and durability, which in turn may provide the health care provider with the ability to increase pressure of during treatment. In other examples, such as when treating thinner muscle groups, the diameter of the tip nearest the oscillating device may be, sometimes substantially, smaller than the diameter of the tip on the end opposing the oscillating device. This may provide a tip with less weight, which may be desired when the surface area of treatment is comparatively large but increased pressure is not desired, such as when treating a less athletically-built patient. The degree of protuberance of the convex-shaped first end may also vary. In an example, the degree of protuberance may be slight, such that the surface of the tip that contacts the patient is only slightly convex. In other examples, the degree of protuberance may more pronounced, such that the surface of the tip that contacts the patient is appreciably convex, which may resemble a more rounded surface.

At block 806, method 800 may include contacting the tip to the body of the patient. The health care provider may place the tip over the desired portion of the patient's body such that all or a portion of the desired body part rests in the indent, in an example, and is straddled by the side walls of the second portion. This configuration of the tip may allow the health care provider to move the tip up and down a muscle while keeping the tip from vibrating off of the body part of interest.

A health care provider may use the angled tip, described above, by contacting the patient with the sloped portion instead of, or in addition to, the substantially pointed portion. By treating a patient with the sloped portion, pressure created during treatment may be partially deflected away from the area of treatment. The health care provider may adjust the angle at which the tip contacts the patient to increase or decrease contact with the sloped portion.

At block 808, method 800 may include enabling the oscillating device such that oscillation of the tip occurs.

At block 810, method 800 may include exerting a certain amount of force during oscillation depending on the chosen tip and desired therapeutic effect. The health care provider may change tips during a treatment session to treat additional areas of the body and/or additional tissues. The health care provider may also rotate the tips during a treatment session to treat additional areas of the body or for in-treatment adjustment to increase efficacy of the treatment.

The tips may comprise varying durometers and designs and be interchangeable without substantial effort or time.

A health care provider may use the methods described herein for a single treatment or for a treatment regimen, which may include use of one or many of the tips described herein. The length of treatment, pressure used during treatment, choice of tip, oscillation speed, and choice of body part and/or tissue to treat will vary depending on the health of a given patient and treatment goals.

The term "about" or "approximate" as used in the context of describing a range of volume, pressure, or temperature is to be construed to include a reasonable margin of error that would be acceptable and/or known in the art.

The present description uses specific numerical values to quantify certain parameters relating to the innovation, where the specific numerical values are not expressly part of a numerical range. It should be understood that each specific numerical value provided herein is to be construed as providing literal support for a broad, intermediate, and narrow range. The broad range associated with each specific numerical value is the numerical value plus and minus 60 percent of the numerical value, rounded to two significant digits. The intermediate range associated with each specific numerical value is the numerical value plus and minus 30 percent of the numerical value, rounded to two significant digits. The narrow range associated with each specific numerical value is the numerical value plus and minus 15 percent of the numerical value, rounded to two significant digits. These broad, intermediate, and narrow numerical ranges should be applied not only to the specific values, but should also be applied to differences between these specific values.

Furthermore, this disclosure provides various examples, as described and as illustrated in the figures. However, this disclosure is not limited to the examples described and illustrated herein, but can extend to other examples, as would be known or as would become known to those skilled in the art. Reference in the specification to "one example," "this example," "these examples" or "some examples" means that a particular feature, structure, or characteristic described is included in at least one example. The appearances of these phrases in various places in the specification are not necessarily all referring to the same example, nor are they mutually exclusive. That is, features, structures, and characteristics of one example may, but need not necessarily, be combined with features, structures, and/or characteristics of one or more other examples.

CONCLUSION

Although the disclosure describes examples having specific structural features and/or methodological acts, it is to be understood that the claims are not necessarily limited to the specific features or acts described. Rather, the specific features and acts are merely illustrative of some examples that fall within the scope of the claims of the disclosure.

What is claimed is:

1. A medical tool, comprising:

a post, the post having a distal end and a proximal end, the proximal end sized to be received by an oscillating tool; and a head constructed at least partially of a polymeric material, the polymeric material covering at least a portion of the distal end of the post and coupled to the post, the head having a durometer between approximately −50 A and approximately 100 A, wherein at least a first portion of the head is substantially cylindrical and a second portion of the head is concave such that an indent is defined on one end of the head, the indent having a depth gradient such that the indent is more pronounced on one side of the one end of the head and less pronounced on another side of the one end of the head.

2. The tool of claim 1, wherein the post includes a core.

3. The tool of claim 1, wherein the head is releasably coupled to the post.

4. The tool of claim 1, wherein the post comprises a first post, the head comprises a first head, and the tool further comprises a second post and a second head covering at least a portion of the second post, wherein a first end of the second head is convex, the first end having a diameter that is greater than a second end of the second head.

5. The tool of claim 1, wherein the post comprises a first post, the head comprises a first head, the indent comprises a first indent, and the tool further comprises a second post and a second head covering at least a portion of the second post, wherein at least a first portion of the second head includes a second indent and a third indent, the second indent disposed within the third indent, the second indent being narrower than the third indent.

6. The tool of claim 1, wherein the first portion of the head has a first durometer and the second portion of the head has a second durometer, the first durometer being different from the second durometer.

7. The tool of claim 1, wherein the post comprises a first post, the head comprises a first head, and the tool further comprises a second post and a second head covering at least a portion of the second post, at least a first portion of the second head being substantially cylindrical and an end of the second head being angled such that a first side of the end of the second head is higher than a second side of the end of the second head.

8. A medical tool, comprising:

a tip, the tip including a post and a head coupled to an end of the post, the head constructed at least partially of a polymeric material having a durometer between approximately −50 A and approximately 100 A, wherein at least a first portion of the head includes a first indent and a second indent, the first indent disposed within the second indent, the first indent being narrower than the second indent.

9. The tool of claim 8, wherein the tip comprises a first tip, the post comprises a first post, the head comprises a first head, and the tool further comprises a second tip including a second post and a second head coupled to a first end of the second post, wherein at least a first portion of the second head is substantially cylindrical and a second portion of the second head is concave such that a third indent is defined on one end of the second head.

10. The tool of claim 9, wherein the third indent has a depth gradient such that the third indent is more pronounced on one side of the one end of the second head and less pronounced on another side of the one end of the second head.

11. The tool of claim 8, wherein the tip comprising a first tip, the post comprises a first post, the head comprises a first head, and the tool further comprises a second tip including a second post and a second head coupled to a first end of the second post, wherein at least a first portion of the second head is substantially cylindrical and an end of the second head is angled such that a first side of the end of the second head is higher than a second side of the end.

12. The tool of claim 8, wherein the tip, when received by an oscillating tool, is rotatable about the post.

13. A medical apparatus, comprising:

a plurality of tips, individual one of the plurality of tips having a proximal end sized to be received at least partially in an oscillating tool, the plurality of tips being interchangeable and being constructed at least partially of a polymeric material, wherein a tip of the plurality of tips comprises a post and a head coupled to a first end of the post, the polymeric material has a durometer between approximately −50 A and approximately 100 A, wherein at least a first portion of the head includes a first indent and a second indent, the first indent disposed within the second indent, the first indent being narrower than the second indent.

14. The apparatus of claim 13, wherein:

the tip comprises a first tip;

the post comprises a first post;

the head comprises a first head; and a second head of a second tip of the plurality of tips is substantially cylindrical and a portion of the second head is concave such that a third indent is defined on one end of the second head.

15. The apparatus of claim 14, wherein the third indent has a depth gradient such that the third indent is more pronounced on one side of the second head and less pronounced on another side of the second head.

16. The apparatus of claim 13, wherein the plurality of tips, when each is received by the oscillating tool, is rotatable about the post.

* * * * *